United States Patent [19]

Becker et al.

[11] Patent Number: 4,881,476

[45] Date of Patent: Nov. 21, 1989

[54] CYCLONE REACTOR WITH INTERNAL SEPARATION AND AXIAL RECIRCULATION

[75] Inventors: Frederick E. Becker, Reading; Leo A. Smolensky, Concord, both of Mass.

[73] Assignee: The United States of America as represented by the United States Department of Energy, Washington, D.C.

[21] Appl. No.: 224,413

[22] Filed: Jul. 26, 1988

[51] Int. Cl.[4] ..... F23D 1/04

[52] U.S. Cl. ..... 110/347; 110/264; 422/188

[58] Field of Search ..... 110/264, 302, 347; 431/173; 422/188

[56] References Cited

U.S. PATENT DOCUMENTS

| | | | |
|---|---|---|---|
| 2,704,444 | 5/1955 | Van Loon | 110/264 |
| 2,769,411 | 11/1956 | Simmons | 110/264 |
| 4,422,388 | 12/1983 | Raskin | 110/264 X |
| 4,442,795 | 4/1984 | Strohmeyer, Jr. . | |
| 4,445,844 | 5/1984 | Matthews . | |
| 4,454,838 | 6/1984 | Strohmeyer, Jr. . | |
| 4,624,191 | 11/1986 | Zauderer et al. . | |
| 4,651,654 | 3/1987 | Erlandson et al. | 110/302 X |
| 4,679,511 | 7/1987 | Holmes et al. . | |
| 4,704,084 | 11/1987 | Liu et al. . | |
| 4,708,092 | 11/1987 | Engstrom . | |

OTHER PUBLICATIONS

PETC-87-FR-1, Final Report unde U.S. DOE Contract No. DE-FG22-86PC90266.

Quarterly Report for the Period of Jan. 22, 1987-Apr. 30, 1987.

Topical Report, "Preliminary Component Design Package" Aug. 1987.

*Primary Examiner*—Edward G. Favors

*Attorney, Agent, or Firm*—Helen S. Cordell; John M. Albrecht; Judson R. Hightower

[57] ABSTRACT

A cyclone combustor apparatus contains a circular partition plate containing a central circular aperture. The partition plate divides the apparatus into a cylindrical precombustor chamber and a combustor chamber. A coal-water slurry is passed axially into the inlet end of the precombustor chamber, and primary air is passed tangentially into said chamber to establish a cyclonic air flow. Combustion products pass through the partition plate aperture and into the combustor chamber. Secondary air may also be passed tangentially into the combustor chamber adjacent the partition plate to maintain the cyclonic flow. Flue gas is passed axially out of the combustor chamber at the outlet end and ash is withdrawn tangentially from the combuston chamber at the outlet end. A first mixture of flue gas and ash may be tangentially withdrawn from the combustor chamber at the outlet end and recirculated to the axial inlet of the precombustor chamber with the coal-water slurry. A second mixture of flue gas and ash may be tangentially withdrawn from the outlet end of the combustor chamber and passed to a heat exchanger for cooling. Cooled second mixture is then recirculated to the axial inlet of the precombustor chamber. In another embodiment a single cyclone combustor chamber is provided with both the recirculation streams of the first mixture and the second mixture.

49 Claims, 6 Drawing Sheets

CYCLONE REACTOR WITH INTERNAL SEPARATION AND AXIAL RECIRCULATION

CONTRACTUAL ORIGIN OF THE INVENTION

The U.S. Government has rights in this invention pursuant to Contract No. DE-AC22-87PC79650 between the U.S. Department of Energy and Tecogen, Inc.

BACKGROUND OF THE INVENTION

The present invention relates to cyclone combustor apparatus for burning ultra-fine coal particles. In particular, this invention relates to a cyclone combustor for burning micronized coal particles or a coal-water slurry of micronized coal particles. More particularly, this invention relates to such a cyclone combustor which has a low thermal input which makes it suitable for use as a heating unit for a single-family dwelling, for a small industrial building, for a small retail sales establishment, and the like.

Many apparatus designs for the combustion of pulverized coal particles are known in the art. In general, they take the form of a fixed fluidized bed or a circulating fluidized bed, and they are designed for high thermal inputs such as that required for service as a public utility steam generator.

Cyclone coal combustors are also known in the art. A cyclone coal combustor is, in general, a horizontal cylindrical device into which pulverized coal is injected with primary air, the air-coal mixture then being centrifuged with secondary air toward the cylindrical wall of the cyclone combustor. When coal particles burn while in the air suspension or on the wall of the cyclone combustor at hot oxidizing temperatures, such as at an average temperature of about 3000° F., the ash particles in the coal melt. Those ash particles which are in the gas suspension are melted and thrown to the wall by the centrifugal force within the cyclone coal combustor. This liquefied ash, called slag, rapidly coats the wall and is continuously drained by the action of gravity toward the bottom of the cylindrical combustor chamber and it is collected at a position downstream of the inlet end of the chamber. In conventional practice it is then removed through a port called a slag tap. Such a cyclone coal combustor is illustrated in U.S. Pat. No. 4,624,191. This cyclone coal combustor is also generally oriented toward high thermal inputs of from about 1 million BTU per hour to about 100 million BTU per hour.

It is an object of the present invention to provide a coal combustor having a low thermal input which makes it suitable for use as a residential heating unit and the like.

It is another object of the present invention to provide a coal combustor having a high combustion efficiency.

It is a further object of the present invention to provide a low capacity coal combustor which has a high turndown ratio.

These and other objects of the invention, as well as the advantages thereof, will become clear from the disclosure which follows.

SUMMARY OF THE INVENTION

To accomplish the foregoing objectives, the present invention provides a reaction vessel having a cylindrical combustor chamber and a smaller cylindrical precombustor chamber where initial ignition and combustion of the coal particles occurs. A circular partition plate having a central circular opening is positioned between the precombustor chamber and the combustor chamber to confine the larger coal particles within the precombustor until combustion has reduced the particle size. Coal particles may enter the precombustor axially at its inlet end either as an air suspension or as a coal-water slurry. Alternatively, the coal particles may be introduced tangentially near the cylindrical wall of the precombustor chamber.

Primary combustion air is introduced tangentially in the precombustor chamber and it establishes a cyclonic flow within the precombustor. The cyclonic flow throws the coal particles against the cylindrical wall by centrifugal force. As the particles are oxidized by air, their size diminishes and the smaller particles move inwardly in the cyclonically circulating air. Eventually the particle size is small enough due to combustion so that aerodynamic drag will overcome centrifugal force, and the particles will then leave the precombustor through the central opening in the partition, thereby passing into the combustor chamber where final combustion occurs.

Secondary air may be introduced tangentially into the top of the combustor chamber to assist in combustion and in maintaining the cyclonic flow. If secondary air is utilized, the total combustion air will be about 60 to 70% primary air and about 30 to 40% secondary air.

The temperature within the precombustion chamber is low enough to inhibit slag formation and prevent particles of ash from sticking to the reactor walls. That is to say, the ash which is formed by combustion will not melt. On the other hand, the temperature within the precombustor is sufficiently high for intensive water evaporation and coal combustion to occur.

One variation of the method and apparatus aspects of the present invention includes recirculation of hot gases and ash particles. Recirculation of the hot flue gas and particles is accomplished within the combustor by utilizing the pressure differences which occur naturally in vortical flows. In this case, due to the centrifugal force, the pressure near the combustor walls is much higher than the pressure in the zones along the combustor axis. This pressure difference is sufficient to allow for intensive recirculation of flue gases and ash particles. The gas and ash mixture may be withdrawn from a position along the combustor wall where high pressure exists, and returned to the combustor by an external conduit to a position along the axis where low pressure exists. This is referred to hereinafter as "axial recirculation".

The coal feed stock which is utilized in the present invention is preferably an ultra-fine coal in contrast to the pulverized coal which is used in larger combustion installations such as for a utility service. The ultra-fine coal has a coal particle size of from about 5 to about 40 microns whereas the pulverized coal has a much larger particle size. It is preferred that the feedstock for the combustor of this invention be a coal-water slurry of micronized coal having a particle size in the range from about 5 to 40 microns, although the feed stock may be a coal-air suspension. Coal-water slurry is commercially available in 1,000 gal. lots. The slurry mass is about 65% water and 35% coal particles.

The combustor of the present invention is designed to burn about 1 gallon per hour of the coal-water slurry in order to generate a thermal output of about 100,000 BTU/hour with a combustion efficiency of about 99% or greater. The combustion chamber has an internal volume of about 0.5 ft.$^3$ in order to meet a combustion intensity goal of 200,000 BTU/hr.-ft$^3$. The vortex velocity in the precombustor chamber is about 15 ft./sec. (cold). This provides an air inlet air flow of about 20 to 40 scfm, with a primary air inlet having an inlet opening of about 3.2 square inches.

The combustor apparatus and system of this invention has several advantages over prior art units. The combustor provides a higher carbon burnout since separation of relatively coarse and fine particles, and the selective retention of larger coal particles, results in a longer solids residence time. The unit also improves combustion due to intensive turbulent mixing of the solids and the combustion air within the vortex. Additionally, the unit lowers droplet agglomeration just after the coal-water slurry has been atomized, since centrifugal forces promote spreading out of the cloud of atomized droplets that is entering the precombustor chamber and, thus, the distances between individual droplets inside this cloud are increased.

The unit further provides for a simplified start-up and a reduced time is required for the system to preheat. An oil-firing jet nozzle is utilized to preheat the precombustor chamber, and the relatively small volume of the precombustor chamber requires only a very few minutes to reach the slurry ignition temperature.

This unit also has an increased turndown ratio. Due to the higher concentration of solids circulating within the precombustor, higher temperature stability and therefore a lower load can be maintained. That is to say, although the combustor apparatus of this invention is designed for a full capacity operation at about 100,000 BTU/hr., the use of axial recirculation allows the unit to keep running at loads of 25,000 BTU/hr. or even less. Thus, the unit has a turndown ratio of 4:1 or even higher.

In its apparatus aspects one preferred embodiment of the present invention comprehends a chemical reaction vessel, suitable for use as a combustor for burning fine coal particles, which includes in combination:

(a) A first reaction chamber having an inlet end wall containing a central first fluid inlet opening, a first circular discharge end wall containing a central circular first fluid outlet opening, and a first cylindrical wall therebetween containing a tangential second fluid inlet opening proximate the inlet end wall; and, (b) A second reaction chamber contiguous with the first reaction chamber, having a second cylindrical wall encompassing the first circular discharge end wall, having a tangential third fluid inlet opening in the portion of the second cylindrical wall proximate the first circular discharge end wall, having a circular second discharge end wall containing a central circular second fluid outlet opening, and having a tangential third fluid outlet opening in the portion of the second cylindrical wall proximate to the second discharge end In another preferred embodiment the chemical reaction vessel includes a tangential fourth fluid outlet opening in the second cylindrical wall proximate the second circular discharge end wall, first conduit means providing communication between the fourth fluid outlet opening and the first fluid inlet opening, and fluid inlet means forming a fourth fluid inlet opening in the first conduit means proximate the fourth fluid outlet opening.

In yet another preferred embodiment the chemical reaction vessel includes a tangential fifth fluid outlet opening in the portion of the second reaction chamber cylindrical wall proximate the second reaction chamber discharge end wall. A second conduit means provides means of communication between the fifth fluid outlet opening and the first fluid inlet opening. The second conduit means also includes heat exchanger means.

In its method aspects the present invention comprehends a method for burning a coal-water slurry which includes the steps of:

(a) passing a feed stream containing a coal-water slurry into the inlet of a cylindrical first combustion chamber having an inlet end wall, a first circular discharge end wall, and a first cylindrical side wall;

(b) passing a first combustion air stream tangentially into the inlet end of the cylindrical first combustion chamber under conditions sufficient to maintain a helical flow within the first combustion chamber and propel suspended coal particles centrifugally toward the cylindrical side wall of the chamber;

(c) withdrawing a combustion product stream comprising steam, combustion gas components, unconsumed air components, uncombusted coal particles, and ash particles axially from the discharge end wall of the first combustion chamber;

(d) passing the combustion product stream into the inlet end of a cylindrical second combustion chamber having a second circular discharge end wall and a second cylindrical side wall;

(e) passing a second combustion air stream tangentially into the inlet end of the second combustion chamber under conditions sufficient to maintain a helical flow within the second combustion chamber and propel suspended coal and ash particles centrifugally toward the second cylindrical side wall of the chamber;

(f) withdrawing ash particles tangentially from the discharge end of the second combustion chamber; and, (g) withdrawing flue gas axially from the discharge end of the second combustion chamber.

In another embodiment of the method invention, the method includes the further steps of withdrawing a first mixture stream containing flue gas and ash particles tangentially from the discharge end of the second combustion chamber, passing coal-water slurry into the first mixture stream and thereby producing a second mixture stream, and passing the second mixture stream into the first cylindrical combustion chamber as at least a portion of the feed stream of step (a).

In a further method embodiment of the present invention, the method includes the steps of withdrawing a third mixture stream containing flue gas and ash particles tangentially from the discharge end of the second combustion chamber, passing the third mixture stream through heat exchanger means, and returning the cooled third mixture stream to the first cylindrical combustion chamber as a portion of the feed stream of step (a).

A clearer understanding of the present invention will be obtained from the disclosure which follows when read in light of the accompanying drawings.

DESCRIPTION OF THE PREFERRED EMBODIMENTS

Figure 2:
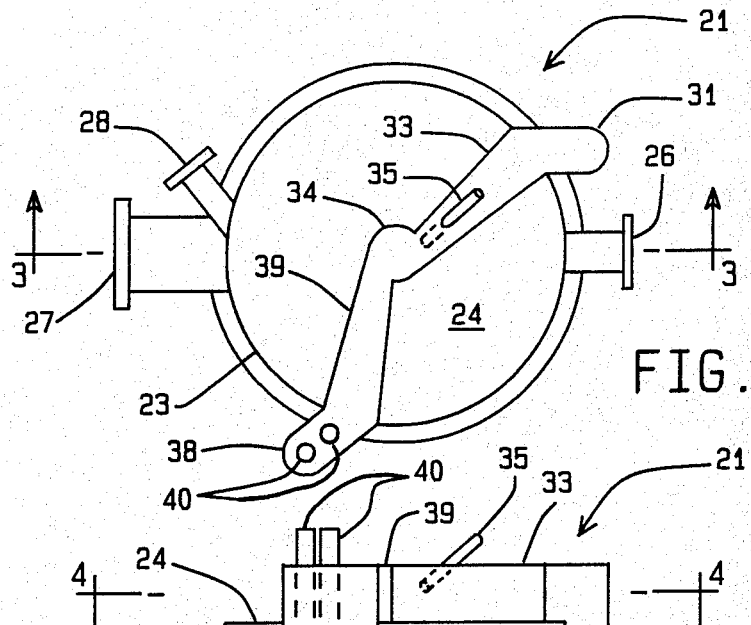
FIG. 2 is a plan view of the cyclone combustor apparatus of FIG. 1.
Figure 1:
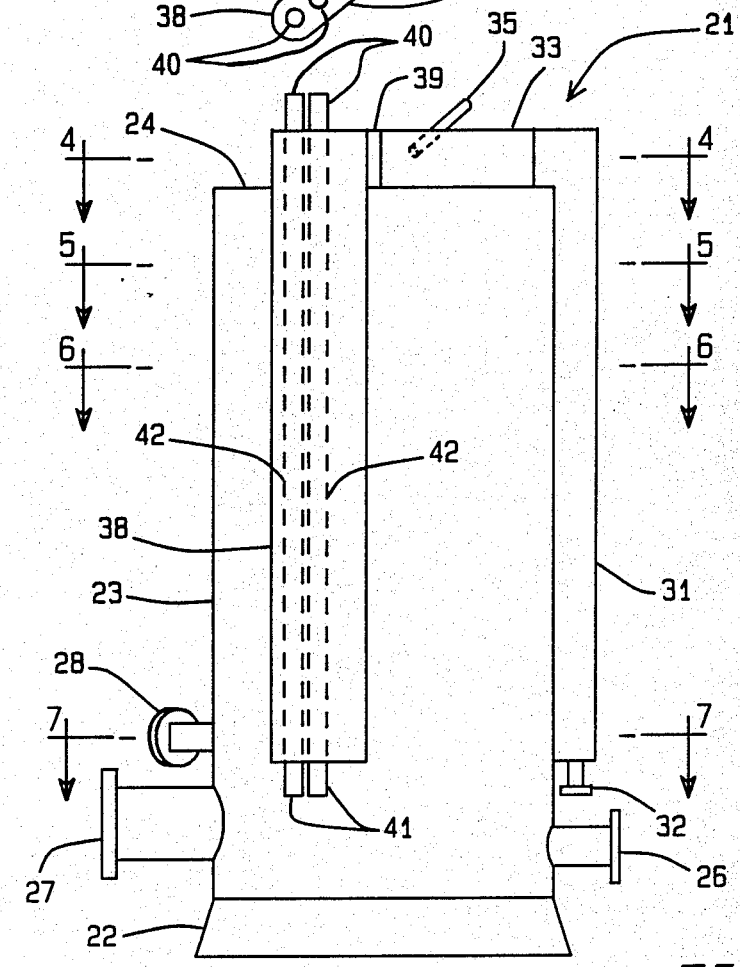
FIG. 1 is a front elevational view of one embodiment of the cyclone combustor apparatus of the present invention.

FIGS. 1 through 7 illustrate one preferred embodiment of the present invention which comprises a chemical reaction vessel used as a cyclone combustor apparatus having a precombustor chamber and a combustor chamber. FIGS. 1 and 2 show the external features of the vessel and FIGS. 3 through 7 show the internal structure of the vessel.

Figure 3:
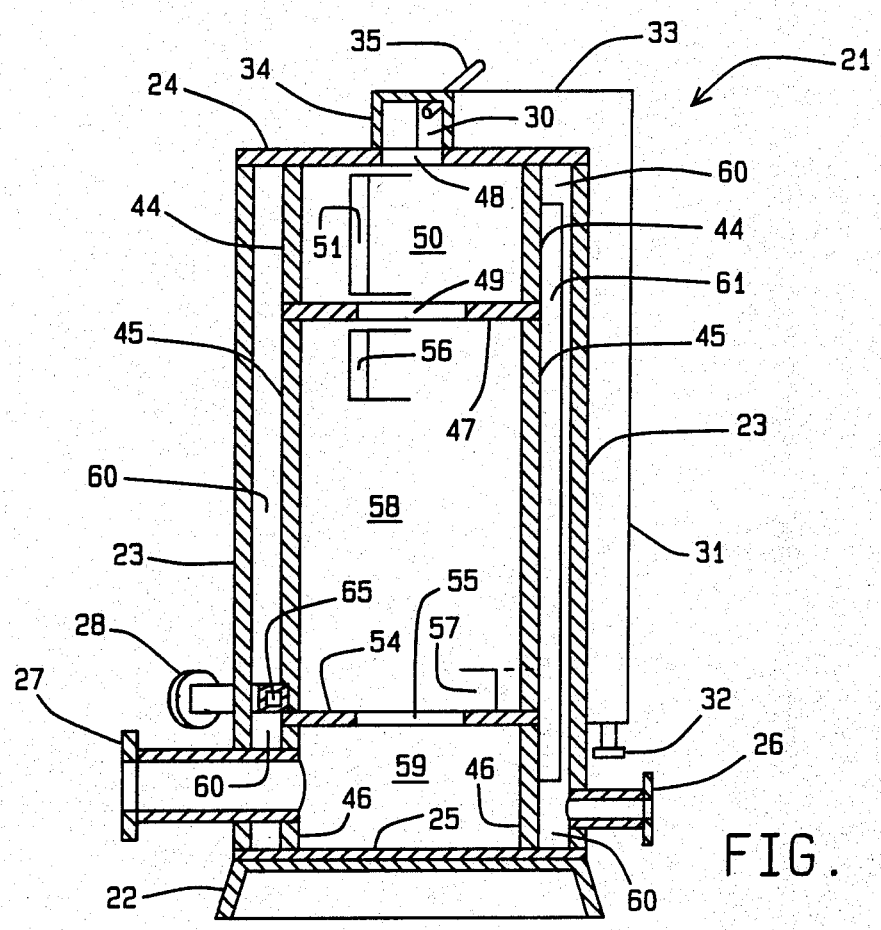
FIG. 3 is a sectional view of the cyclone combustor apparatus taken along section line 3—3 of FIG. 2.

Referring now to FIGS. 1 and 2, there is shown a reaction vessel 21 having a supporting base 22, an outer shell 23, a top head 24, and a bottom head 25 (seen more clearly in FIG. 3). A flanged air inlet 26 enters the outer shell 23 and a flanged flue gas outlet 27 provides an exit from the reaction vessel. A flanged ash outlet 28 is also provided.

A first axial recirculating conduit 31 runs up the back side of the outer shell 23. Conduit 31 has a flanged feedstock inlet 32 on the bottom. The conduit 31 crosses over the top head 24 of the reaction vessel in a first tangential return conduit 33 which enters a cylindrical inlet chamber 34. A fuel oil preheating nozzle 35 is located in the top of the first tangential return conduit 33. This fuel oil preheating nozzle is used when the reaction vessel is initially started up. It provides fuel oil to heat the precombustion chamber to a temperature which will sustain the ignition of a coal-water slurry which is fed into the vessel via inlet 32.

On the front face of the vessel 21 there is a second axial recirculation conduit 38. This conduit crosses over the top head 24 of the vessel in a second tangential return conduit 39 which enters the cylindrical inlet chamber 34. The second tangential return conduit 39 contains a plurality of heat exchanger cooling tubes 42, which are shown as straight tubes although it is also possible for them to be coiled tubes. The cooling tubes have an inlet end 40 and an outlet end 41.

Figure 4:
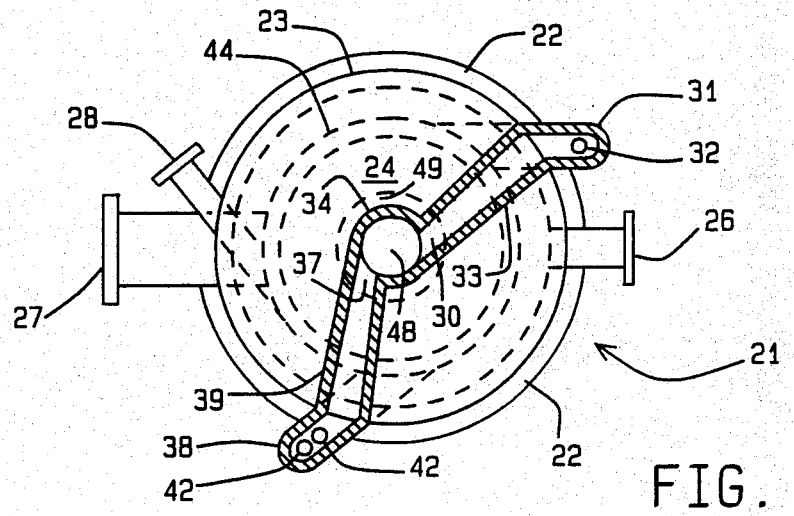
FIG. 4 is a sectional view of the cyclone combustor apparatus taken along section line 4—4 of FIG. 1.

Referring now to FIGS. 3 and 4, it will be seen that the outer shell 23 confines a precombustor chamber 50, a combustor chamber 58, and a plenum chamber 59. These chambers are formed by an upper cylindrical chamber wall 44, a central cylindrical chamber wall 45, and a lower cylindrical chamber wall 46. An upper partition plate 47 is positioned between the precombustor chamber 50 and the combustor chamber 58. This upper partition plate contains a circular aperture 49 which is centrally located. The top head 24 of the vessel contains a circular inlet aperture 48 which is in between the precombustor chamber 50 and the cylindrical inlet chamber 34. It will be seen that the first tangential return conduit 33 terminates at the cylindrical inlet chamber 34 in a tangential inlet opening 30. Similarly, the second tangential return conduit 39 terminates at the cylindrical inlet chamber 34 in a tangential inlet opening 37 (seen in FIG. 4). The central aperture 48 provides an axial inlet opening for the precombustor chamber 50. The precombustor chamber has a tangential primary air inlet 51 and the combustor chamber has a tangential secondary air inlet 56 which is located proximate the upper partition plate 47.

The combustor chamber 58 has a lower partition plate 54 having a circular central aperture 55. A tangential fluid exit opening 57 is located at the bottom of the combustor chamber and adjacent to the lower partition plate 54. There is also a tangential ash exit opening 65 which passes ash to the flanged rectangular exit conduit 28. The tangential exit opening 57 provides a recirculation exit opening which allows for the passage of a mixture of flue gas and ash into the first axial recirculation conduit 31. When the ash and hot flue gas enter the conduit 31 they meet a coal-water slurry stream which enters via flanged inlet 32. Because of the heat in the recirculation stream, the slurry is vaporized and thereby suspends the coal particles in the mixture of flue gas, ash, and water vapor. The ash and coal particles are swept upwardly in conduit 31 and pass into the tangential conduit 33, whereupon they are discharged via the tangential inlet opening 30 into the inlet chamber 34. The mixture then passes downwardly through the central opening 48 in the top head 24 where it meets the tangential primary air stream which sweeps the cloud of flue gas, moisture vapor, ash and coal particles against the cylindrical wall 44 of the precombustor chamber.

Flue gas is discharged centrally from the combustor chamber through the partition plate 54 via aperture 55. The flue gas enters the flue gas plenum chamber 59 which is confined between the partition plate 54, the lower cylindrical chamber wall 46, and the bottom head 25. Flue gas exits from the flue gas plenum chamber 59 via the flue gas outlet nozzle 27.

An annular space 60 is confined between the outer shell 23 and the cylindrical chamber walls 44, 45 and 46. This annular space provides a passageway through which the combustion air passes. As the air passes up the passageway from the bottom of the annular space it is heated by the surface of the cylindrical chamber walls. In order to enhance heat transfer from the precombustor chamber, the combustor chamber, and the plenum chamber, a plurality of radial vanes 61 is provided on the cylindrical chamber surfaces. These heat transfer vanes are more clearly seen in FIGS. 5, 6 and 7. Only three heat transfer vanes are illustrated in these three cross sectional figures, but the plurality of vanes extends around the entire periphery of the three inner chambers as shown by the phantom line 62.

FIG. 4 is a cross sectional view which illustrates how the axial recirculation conduits 31 and 38 discharge the flue gas and ash back into the top of the precombustor chamber 50. As seen in FIG. 4, the axial recirculation conduit 31 has an opening at its bottom for the introduction of the coal-water slurry via the inlet line 32. As the mixture of flue gas, ash, water vapor and coal particles flows upwardly in conduit 31, it crosses over within the tangential return conduit 33 and is discharged via the tangential inlet opening 30 into the cylindrical inlet chamber 34. In a similar manner the flue gas and ash which has been withdrawn from the bottom of the combustor chamber via tangential outlet opening 64 (seen in FIG. 7) passes up the axial recirculation conduit 38 wherein it loses thermal energy to the cooling water which is passing within the cooling tubes 42. The cooled flue gas and ash then is discharged into the second tangential return conduit 39. The ash and flue gas passes via the tangential inlet opening 37 into the cylindrical inlet chamber 34. A mixture of the flue gas, ash, water vapor and coal particles then passes downwardly through the axial inlet opening 48 and into the precombustor chamber 50 wherein it is contacted by the tangentially entering primary air to thereby be circulated in a cyclonic cloud against the precombustor chamber cylindrical wall 44.

Figure 5:
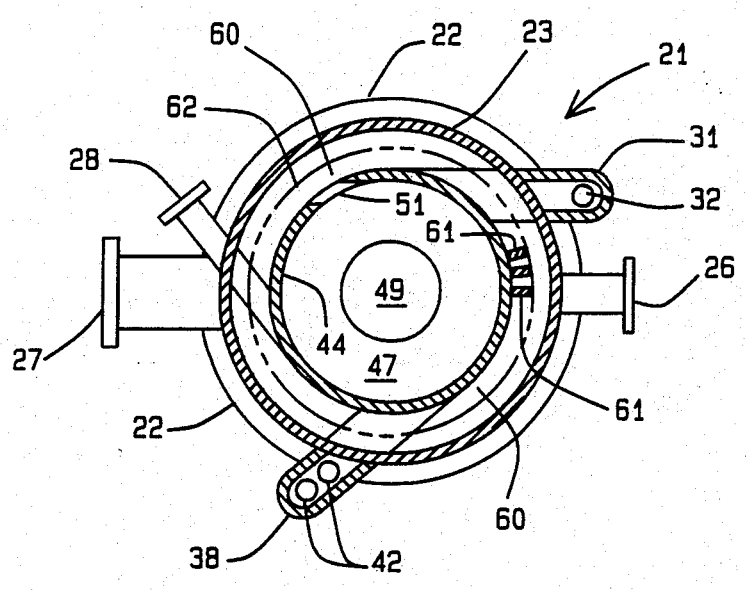
FIG. 5 is a sectional view of the cyclone combustor apparatus taken along section line 5—5 of FIG. 1.

FIG. 5 illustrates the interior of the precombustor chamber 50. It shows in sectional view the cylindrical side wall 44 which has the tangential inlet opening 51, whereby the primary combustion air enters the precombustor chamber. Other elements of the combustor vessel which have been previously discussed are also shown in this figure.

Figure 6:
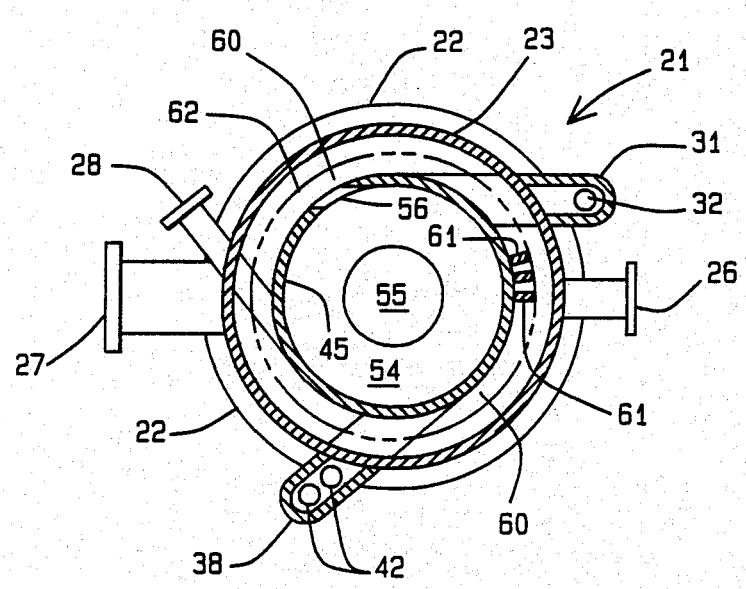
FIG. 6 is a sectional view of the cyclone combustor apparatus taken along section line 6—6 of FIG. 1.

FIG. 6 provides a sectional view of the upper portion of the interior of the combustor chamber 58. This figure shows the tangential inlet opening 56 by means of which the secondary air enters the combustor chamber 58. Tangential air inlet opening 56 is at the top of combustor chamber 58 and proximate to the upper partition plate 47. Other elements of the reaction vessel which have been discussed hereinabove are also seen in FIG. 6.

Figure 7:
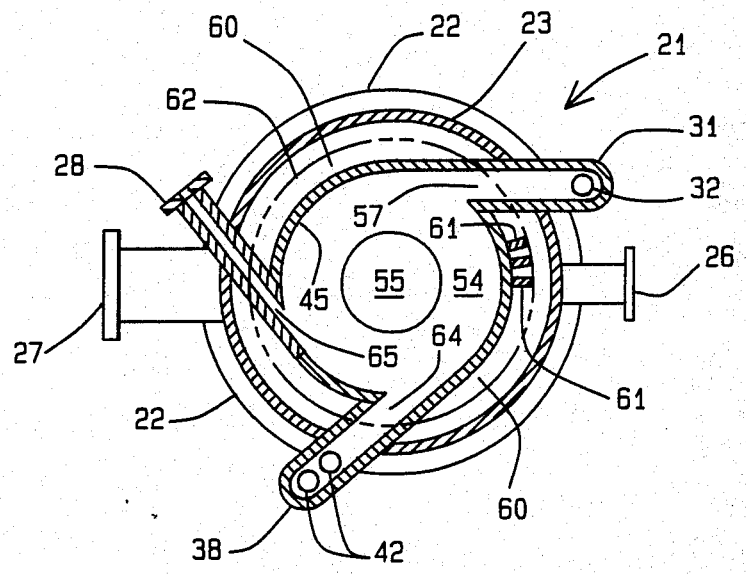
FIG. 7 is a sectional view of the cyclone combustor apparatus taken along section line 7—7 of FIG. 1.

FIG. 7 provides a sectional view of the bottom portion of the combustor chamber 58. This figure shows the tangential outlet opening 57 by means of which hot flue gas and ash are spun out of the combustor chamber 58 by centrifugal force to enter the axial recirculation conduit 31. This figure also shows the tangential exit opening 64 by means of which hot flue gas and ash are spun out of the combustor chamber by centrifugal force to enter the axial recirculation conduit 38. In conduit 38 the flue gas and ash are cooled by the heat exchanger tubes 42 which contain cooling water. FIG. 7 also shows the tangential exit opening 65 by means of which ash is discharged from the combustor chamber. These three tangential exit openings are at the bottom of the combustor chamber proximate to the bottom partition plate 54. The ash which is discharged via the tangential outlet opening 65 contains very little flue gas because it is typically discharged into a closed collection hopper which is not shown in FIG. 7, but which is illustrated and discussed hereinafter in regard to FIG. 10. Other structural elements which have been discussed hereinabove are also shown in FIG. 7.

Axial recirculation conduits 31 and 38 return flue gas and ash to the precombustor chamber at a rate sufficient to keep the flow of gas and water vapor at the design rate within the chambers. This then assures proper residence time for the coal particles and thereby assures high combustion efficiency. As previously noted hereinabove, the pressure balance within the apparatus allows axial recirculation to occur without the use of external fans or blowers. The cyclonic flow within the precombustor and combustor chambers establishes high pressure at the chamber walls and a lower pressure along the central axis of the chambers. This pressure imbalance allows flue gas and ash to leave the combustor chamber via tangential exits 57 and 64 at the bottom of the combustor chamber and return to the top of the precombustor chamber via central opening 48 merely because of the pressure difference.

Elevated temperatures must be avoided in order to keep the ash in a solid particulate state. In order to avoid causing suspended ash particles to eventually totally melt, it is necessary to control the temperature within the system. This is why recirculating conduit 38 contains heat exchanger tubes 42. Water is circulated in tubes 42 at a controlled rate in order to keep the temperature within the precombustor and combustor chambers below the melting point of the ash. Conventional flow control means may be used for this purpose. The melting point of the ash varies with the type of coal but, in general, the temperature should be controlled to give a precombustor wall temperature not greater than about 1950° F.

Figure 8:
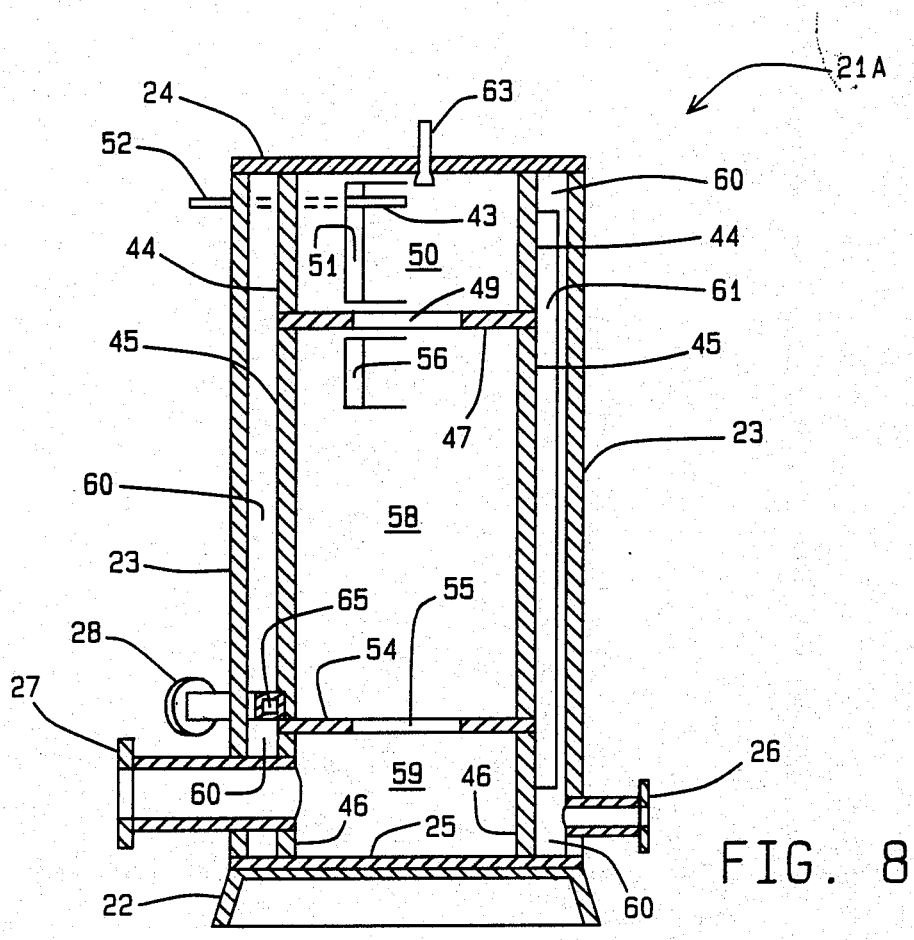
FIG. 8 is a sectional elevational view of another embodiment of the cyclone combustor apparatus.
Figure 9:
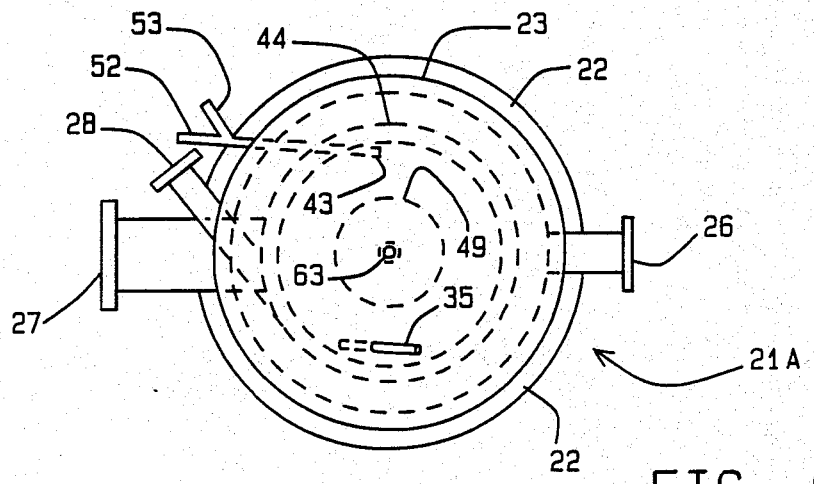
FIG. 9 is a plan view of the cyclone combustor apparatus of FIG. 8.

FIGS. 8 and 9 illustrate an embodiment of the invention which does not contain axial recirculation conduit 31 or axial recirculation conduit 38. Since these conduits are missing in this embodiment, the coal-water slurry must be injected into the precombustor chamber by means other than that shown in FIGS. 1 through 7, where the coal-water slurry was injected into the system at the bottom of the axial recirculation conduit 31. Two means of injecting coal-water slurry into the precombustor chamber of the reaction vessel 21A are shown in FIGS. 8 and 9. It will be clear that these are alternative means of injecting the coal water slurry feedstock, and that they are not operated in conjunction with each other. Other means may also suggest themselves to those skilled in the art.

One means is an air assist Y-type atomizing nozzle 43 which is tangentially projected into the precombustor chamber through the tangential primary air inlet opening 51. The air assist Y-type atomizing nozzle 43 has two inlet sections. The coal-water slurry is introduced into the Y-type nozzle via inlet conduit 52, and compressed air is introduced via inlet 53. The compressed air conventionally is introduced at a pressure not greater than 20 psig.

An alternate means of atomizing the coal-water slurry is an ultrasonic atomizing nozzle 63. The ultrasonic atomizer 63 is located in the central portion of the top head 24. The ultrasonic nozzle does not utilize an air assist, but it relies upon the excitation of the water molecules in the coal-water slurry in order to produce an atomized cloud of water droplets and coal particles.

The auxiliary heating jet 35, which is used to start up the unit by initially burning fuel oil, is located in the top head 24. As most clearly shown in FIG. 9, the oil flame will be tangentially projected into the precombustor chamber. It will be recalled that this start-up oil nozzle 35 was located in the tangential return conduit 33 in the combustor system illustrated in FIGS. 1 through 7.

In running experiments on the combustor system of this invention it was determined that under certain operating conditions the partition plate 47 could be eliminated and a single combustor chamber could be utilized if the axial recirculation rates were sufficiently high to maintain the proper residence time for the coal particles within the combustor chamber. Such an embodiment is illustrated in FIG. 10 and discussed in Example 1.

EXAMPLE ONE

This example is provided to illustrate another design for the cyclone combustor apparatus of the present invention and to illustrate one system of ancillary equipment which may be utilized to recover the thermal energy generated therein. This example discusses the simplified schematic flow diagram of FIG. 10. Although the reaction vessel 21B which is illustrated in FIG. 10 has a combustor chamber without a precombustor chamber, the basic flow described in this example will also apply to an apparatus having both a precombustor chamber and a combustor chamber.

Figure 10:
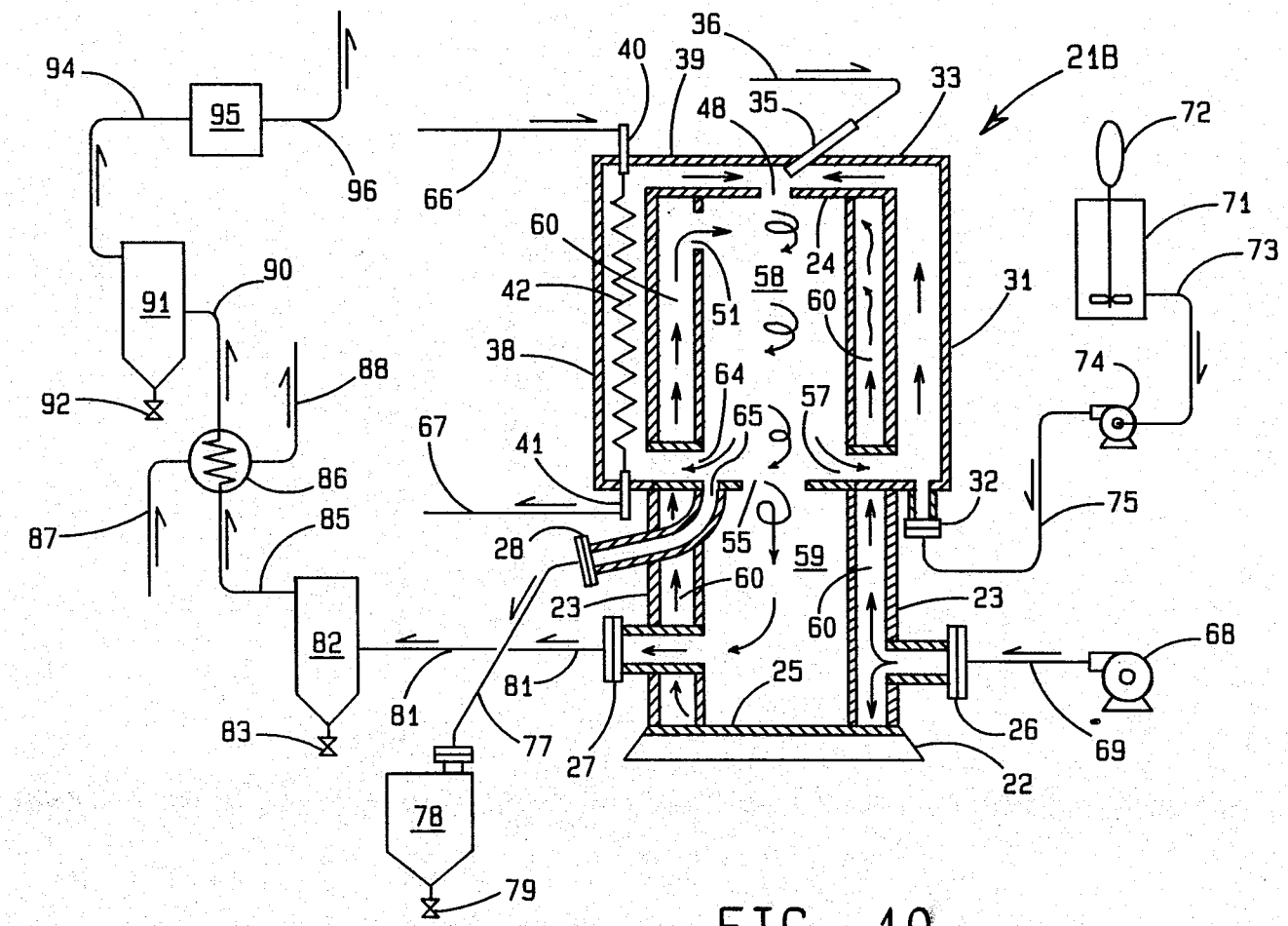
FIG. 10 is a simplified schematic flow diagram of another embodiment of the cyclone combustor apparatus illustrating one system of ancillary equipment which may be utilized to recover the thermal energy generated in the combustor apparatus.

Referring now to FIG. 10, the feedstock of coal-water slurry is held in a feed tank 71. In order to maintain a suspension of the coal particles within the slurry, feed tank 71 includes a motor driven agitator apparatus 72. Coal-water slurry is withdrawn from feed tank 71 via suction line 73 by means of a peristaltic pump 74. The coal-water slurry is withdrawn at a rate of about 1.0 gpm in order to generate about 100,000 BTU per hour in the vessel 21B. The peristaltic pump 74 discharges the coal-water slurry via feed line 75 into the inlet nozzle 32. Inlet nozzle 32 feeds the coal-water slurry into the axial recirculation conduit 31.

The coal-water slurry is met by a hot stream of flue gas and ash which is passed out of the combustor chamber 58 via tangential exit opening 57. This hot stream of flue gas and ash causes the water of the coal-water slurry to vaporize. The mixture of flue gas, water vapor, ash and coal particles passes upwardly in axial recirculation conduit 31 and into the tangential return conduit 33. The coal-water slurry provides from about 5 to about 10% of the mass flow in this axial recirculation conduit.

Additionally, a mixture of flue gas and ash is withdrawn from the combustor chamber 58 via the tangential exit opening 64 and it enters the axial recirculation conduit 38 wherein it loses heat to heat exchanger tubes 42 which contain flowing cooling water. Cooling water is fed into the exchanger tubes 42 via supply line 66 and inlet ends 40. The cooling water is heated sufficiently in the heat exchanger tubes 42 so that when it exits from tubes 42 via outlets 41 and discharge line 67 it is in the condition of a hot water stream or steam. The hot water or steam is passed by line 67 to a user apparatus not shown.

The cooled flue gas and ash exits from the axial recirculation conduit 38 via the tangential return conduit 39. The cooled mixture of flue gas and ash in conduit 39 meets with the hot mixture of flue gas, ash, water vapor, and coal particles in conduit 33 above the axial inlet opening 48. These two streams mix and enter the combustor chamber 58 via the axial inlet opening 48.

The preheating nozzle 35 which utilizes fuel oil entering via feed line 36 is positioned in the top of the tangential return conduit 33 in order to provide for preheating of the combustor chamber before initial start-up with the coal-water slurry. Fuel oil is burned by this nozzle 35 for about 3 to 5 minutes in order to bring the temperature within the combustor chamber up to a level of about 1,500° F. At this point the coal-water slurry can be injected into the axial recirculation conduit 31 and it will sustain its own combustion when it enters the hot combustor chamber.

When the mixture of flue gas, ash, water vapor, and coal particles enters the combustor chamber 58 via the axial inlet 48, it meets the primary combustion air which enters via air inlet opening 51 in a tangential flow. This establishes a cyclonic condition within the combustor chamber 58. The vortex velocity which is illustrated by the helical flow arrows within the combustor chamber 58 is about 15 feet per second (cold). When the vortical flow within the system reaches the bottom of the combustor chamber 58, about 20% of the flue gas and ash flows out via tangential exit opening 57 and about 20% of the flue gas and ash exits via tangential exit opening 64. The remaining 60% of the flue gas passes out of the combustor chamber via central opening 55 as shown by the helical arrow within the flue gas plenum chamber 59.

Air is supplied to the system by an induced draft fan 68 which delivers air at about 20 to 40 cubic feet per minute. The air leaves the induced draft fan 68 via line 69 and enters the air inlet nozzle 26. The air then enters into the annular space 60 and passes upwardly along the outer surface of the plenum chamber 59 and the combustor chamber 58 to pick up heat. (Heat exchanger vanes 61 on the outer surface of combustor chamber 58 and plenum chamber 59 are not shown for purposes of simplicity in FIG. 10.) The preheated air enters the combustor chamber via tangential inlet opening 51 at a temperature of about 1,500° F.

Solid ash particles are withdrawn from the combustor chamber 58 via tangential exit opening 65. They are passed via the ash outlet nozzle 28 and line 77 into a closed ash hopper vessel 78. Since this is a closed vessel, very little flue gas exits from the combustor chamber via tangential outlet opening 65, and only particulate ash enters the closed ash hopper 78. A manual drain valve 79 is provided at the bottom of the closed ash hopper for periodic removal of ash particles.

Flue gas exits from the flue gas plenum chamber 59 via the flue gas exit nozzle 27 at a temperature of from about 2,400° F. to about 2,500° F. The hot flue gas passes via line 81 into a first gravity settling chamber 82. This chamber allows a major portion of any fly ash contained within the flue gas to settle out to the bottom of the chamber. A manual drain valve 83 is provided at the bottom of the chamber for periodic removal of any collected fly ash.

The hot flue gas passes out of the top of the first gravity settling chamber 82 via line 85 and enters a heat exchanger 86 at a temperature of from about 2300° to 2400° F. In general, heat exchanger 86 is a shell and tube heat exchanger although another configuration could be used. Cooling water enters the shell side of the heat exchanger via line 87. The cooling water is heated to provide hot water or steam which then exits via line 88 and is passed to a user apparatus not shown.

Cooled flue gas exits from heat exchanger 86 via line 90 and it enters a second gravity settling chamber 91 wherein additional fly ash may be settled out. The second gravity settling chamber 91 is provided with a manual drain valve 92 for the periodic removal of ash.

The flue gas exits from the second gravity settling chamber via line 94 and enters into a dry bag filter unit 95. Although the filter unit may be a wet or dry bag system, the dry bag system is preferred where the combustor system is run as a residential heating unit. It will be recognized that other filter systems may also be used. The filter unit picks up the remaining fly ash, if any, from the flue gas. The flue gas is then discharged to the atmosphere via vent line 96 at a temperature of about 220° F.

EXAMPLE 2

An experimental run was made with a reaction vessel of this invention utilizing a precombustor chamber and a combustor chamber. The precombustor chamber had a diameter of 8 inches and a height of 6 inches. The combustor chamber had a diameter of 8 inches and a height of 17 inches. The diameter of the central opening 49 in the partition 47 between the precombustor chamber and the combustor chamber was 4 inches. The internal volume of the entire reactor system was about 0.5 cubic foot. The wall thickness for all elements of the combustor reactor system was 0.25 inch and the material of construction was stainless steel. The design vortex velocity in the precombustor chamber was 15 feet per second (cold). The inlet air flow was about 20 to 40 scfm, and the air inlet area for the precombustor chamber was about 3.2 $in^2$.

Steady state test operation with a vertical down flow system, as shown in FIGS. 8 and 9, was established. No axial recirculation was used in this test run. Additionally, no secondary air was utilized in this test run. The coal-water slurry feed rate was about 1 gallon per hour which was designed to provide a thermal input of about 100,000 BTU per hour.

The preheating of the precombustor chamber was undertaken with a fuel oil nozzle which ran for about 5 minutes until the chamber temperature in the precombustor was about 1,500° F. At that point the coal-water slurry was initiated into the precombustor chamber and the fuel oil heating nozzle was shut off. After about 1,700 seconds, the flame temperature for the coal-water slurry stabilized in the range from about 1950° F. to about 2100° F., but it was generally about 2,000° F. Similarly, after about 1700 seconds the wall temperature of the precombustor chamber stabilized at from about 1,800° F. to about 1,920° F., but it was generally about 1,900° F.

The air entered the precombustor chamber at a temperature of about 1,500° F. The wall temperature in the combustor chamber ranged from about 1,400° F. to about 1,600° F. The temperature of the partition between the two chambers was in the range from about 1,800° F. to about 1,900° F.

The combustion efficiency for the system was about 98%. The estimated heat release rate in the precombustor chamber was 570,000 BTU/hr/$ft^3$. The flue gas left the apparatus at a temperature of from 2,400° F. to 2,500° F. but due to insufficient insulation on the outlet line, it was only 1,400° to 1,900° F. when it reached the heat exchanger.

Operation of the unit during this test run was considered to be completely satisfactory. However, it is believed that combustion efficiencies of 99% or greater would be achievable if the apparatus were made of a ceramic or lined with a ceramic, since the metallic structure of the test reaction vessel transmits heat too readily. Silicon carbide is one suitable ceramic for this service.

EXAMPLE 3

In this example a run was undertaken with axial recirculation. The system was run without secondary air and without the partition member 47, so that there was only a single combustor chamber as shown in FIG. 10. Steady state operation of the unit was similar to what was achieved in the foregoing Example 2, and the operation was stable and acceptable.

EXAMPLE 4

In this example the reactor apparatus had both a precombustor chamber and a combustor chamber. The unit was run without axial recirculation and it utilized a Y-type atomizing nozzle for the tangential injection of coal-water slurry at the top of the precombustor chamber. The air assist Y-type atomizing nozzle was inserted into the precombustor chamber by penetrating the nozzle through the primary air inlet 51 as shown in FIGS. 8 and 9. Steady state operation was similar to what was achieved in the foregoing Example 2, and it was stable and satisfactory.

EXAMPLE 5

In this example, the reaction vessel had a precombustor chamber and a combustor chamber with the partition plate in between. The unit was run without axial recirculation and it utilized an ultrasonic atomizing nozzle to feed the coal-water slurry axially into the top of the precombustor chamber as shown in FIGS. 8 and 9. Steady state operation was achieved which was similar to that experienced in Example 2, and the operation was stable and satisfactory.

It is to be noted that although the disclosed embodiments of the present invention illustrate downflow reactor systems, the method and apparatus are not so limited. The reaction vessel may be vertically oriented to run downflow or upflow. It is anticipated that for use as a residential heating unit the system will run downflow, while use as a steam generator for a public utility will dictate an upflow operation. Additionally, the reaction vessel may be horizontally operated, since it is the vortical flow and the pressure differential between the axial regions and the wall regions which governs the basic operation. Moreover, although this combustor apparatus has been designed for thermal outputs of 100,000 BTU/hr. or less, it can also be designed for much larger thermal outputs which render it more appropriate in a small public utility environment.

In light of the foregoing disclosure, further alternative embodiments of the inventive cyclone combustor apparatus will undoubtedly suggest themselves to those skilled in the art. It is thus intended that the disclosure be taken as illustrative only, and that it not be construed in any limiting sense. Modifications and variations may be resorted to without departing from the spirit and the scope of this invention and such modifications and variations are considered to be within the purview and the scope of the appended claims.

The embodiments of this invention in which an exclusive property or privilege is claimed are defined as follows:

1. A chemical reaction vessel, suitable for use as a combustor for burning fine coal particles, which comprises in combination, a reaction chamber having a circular inlet end wall containing a central circular first fluid inlet opening; a circular discharge end wall containing a central circular first fluid outlet opening; a cylindrical reaction chamber wall therebetween containing a tangential second fluid inlet opening proximate said circular inlet end wall and a tangential second fluid outlet opening proximate said circular discharge end wall; and, a cylindrical inlet chamber contiguous with and attached to said reaction chamber, said inlet chamber having a cylindrical inlet chamber wall attached to said reaction chamber circular inlet end wall coincident with and encompassing said central first fluid inlet opening.

2. A chemical reaction vessel suitable for use as a combustor for burning fine coal particles, which comprises in combination, a reaction chamber having a circular inlet end wall containing a central circular first fluid inlet opening; a circular discharge end wall containing a central circular first fluid outlet opening; a cylindrical wall therebetween containing a tangential second fluid inlet opening proximate said circular inlet end wall; and a tangential second fluid outlet opening proximate said circular discharge end wall; and, a tangential third fluid outlet opening in said cylindrical wall proximate said circular discharge end wall, first conduit means providing communications between said third fluid outlet opening and said first fluid inlet opening, and fluid inlet means forming a third fluid inlet opening in said first conduit means proximate said third fluid outlet opening.

3. A chemical reaction vessel according to claim 2 including a cylindrical inlet chamber contiguous with and attached to said reaction chamber, said inlet chamber having a cylindrical inlet chamber wall attached to said reaction chamber circular inlet end wall coincident with and encompassing said central first fluid inlet opening, and said inlet chamber cylindrical wall having a tangential fourth fluid inlet opening communicating with said first conduit means.

4. A chemical reaction vessel according to claim 2 wherein the reaction chamber includes a tangential fourth fluid outlet opening in the reaction chamber cylindrical wall proximate to said reaction chamber discharge end wall, a second conduit means provides means of communication between said fourth fluid outlet opening and said first fluid inlet opening, and said second conduit means includes heat exchanger means.

5. A chemical reaction vessel according to claim 4 including a cylindrical inlet chamber contiguous with and attached to said reaction chamber, said inlet chamber having a cylindrical inlet chamber wall attached to said reaction chamber inlet end wall coincident with and encompassing said central first fluid inlet, and said inlet chamber wall having a tangential fourth fluid inlet opening communicating with said first conduit means and a tangential fifth fluid inlet opening communicating with said second conduit means.

6. A chemical reaction vessel suitable for use as a combustor for burning fine coal particles, which comprises in combination, a reaction chamber having a circular inlet end wall containing a central circular first fluid inlet opening; a circular discharge end wall containing a central circular first fluid outlet opening; and a cylindrical wall therebetween containing a tangential second fluid inlet opening proximate said circular inlet end wall, and a tangential second fluid outlet opening proximate said circular discharge end wall; wherein the reaction chamber includes a tangential third fluid outlet opening in the reaction chamber cylindrical wall proximate to said reaction chamber discharge wall, a conduit means provides means of communication between said third fluid outlet opening and said first fluid inlet opening, and said conduit means includes heat exchanger means.

7. A chemical reaction vessel according to claim 6 including a cylindrical inlet chamber contiguous with and attached to said reaction chamber, said inlet chamber having a cylindrical inlet chamber wall attached to said reaction chamber inlet end wall coincident with and encompassing said central first fluid inlet, and said inlet chamber wall having a tangential third fluid inlet opening communicating with said conduit means.

8. A chemical reaction vessel suitable for use as a combustor for burning fine coal particles, which comprises in combination, a reaction chamber having a circular inlet end wall containing a central circular first fluid inlet opening; a circular discharge end wall containing a central circular first fluid outlet opening; a cylindrical reaction chamber wall therebetween containing a tangential second fluid inlet opening proximate said circular inlet end wall, and a tangential second fluid outlet opening proximate said circular discharge end wall; and, a cylindrical outer shell encompassing said reaction chamber, attached to said reaction chamber inlet end wall and spaced apart from said reaction chamber cylindrical wall to define an annular space, said cylindrical reaction chamber wall having a third fluid inlet opening proximate to said reaction chamber inlet end wall providing communication between said annular space and said reaction chamber.

9. A chemical reaction vessel according to claim 8 wherein a plurality of longitudinal vanes are attached to the outer surface of said reaction chamber cylindrical wall and are projected into said annular space.

10. A chemical reaction vessel, suitable for use as a combustor for burning fine coal particles, which comprises in combination, a reaction chamber having a circular inlet end wall containing a central circular first fluid inlet opening; a circular discharge end wall containing a central circular first fluid outlet opening; a cylindrical reaction chamber wall therebetween containing a tangential second fluid inlet opening proximate said circular inlet end wall, and a tangential second fluid outlet opening proximate said circular discharge end wall; and, a plenum chamber contiguous with and attached to said reaction chamber, having a cylindrical plenum chamber wall encompassing said reaction chamber discharge wall, having a fluid outlet opening in the plenum chamber circular wall, and having a plenum chamber end wall.

11. A chemical reaction vessel, suitable for use as a combustor for burning fine coal particles, which comprises in combination:

a. A first reaction chamber having an inlet end wall containing a central first fluid inlet opening, a first circular discharge end wall containing a central circular first fluid outlet opening, and a first cylindrical wall therebetween containing a tangential second fluid inlet opening proximate the inlet end wall;

b. a second reaction chamber contiguous with said first reaction chamber, having a second cylindrical wall encompassing said first circular discharge end wall, having a tangential third fluid inlet opening in the portion of said second cylindrical wall proximate said first circular discharge end wall, having a circular second discharge end wall containing a central circular second fluid outlet opening, and having a tangential third fluid outlet opening in the portion of said second cylindrical wall proximate to said second discharge end wall.

12. A chemical reaction vessel according to claim 11 including a tangential fourth fluid outlet opening in said second cylindrical wall proximate the second circular discharge end wall, first conduit means providing communication between said fourth fluid outlet opening and said first fluid inlet opening, and fluid inlet means forming a fourth fluid inlet opening in said first conduit means proximate said fourth fluid outlet opening.

13. A chemical reaction vessel according to claim 12 including a cylindrical inlet chamber contiguous with said first reaction chamber, said inlet chamber having a cylindrical inlet chamber wall attached to said first reaction chamber circular inlet end wall coincident with and encompassing said central first fluid inlet opening, and said inlet chamber cylindrical wall having a tangential fifth inlet opening communicating with said first conduit means.

14. A chemical reaction vessel according to claim 12 wherein the second reaction chamber includes a tangential fifth fluid outlet opening in the portion of the second reaction chamber cylindrical wall proximate said second reaction chamber discharge end wall, a second conduit means provides means of communication between said fifth fluid outlet opening and said first fluid inlet opening, and said second conduit means includes heat exchanger means.

15. A chemical reaction vessel according to claim 14 including a cylindrical inlet chamber contiguous with said first reaction chamber, said inlet chamber having a cylindrical inlet chamber wall attached to said first reaction chamber inlet end wall coincident with and encompassing said central first fluid inlet, and said inlet chamber wall having a tangential fifth fluid inlet opening communicating with said first conduit means and a tangential sixth fluid inlet opening communicating with said second conduit means.

16. A chemical reaction vessel according to claim 11 wherein the second reaction chamber includes a tangential fourth fluid outlet opening in the second reaction chamber cylindrical wall proximate said second reaction chamber discharge end wall, a conduit means provides means of communication between said fourth fluid outlet opening and said first fluid inlet opening, and said conduit means includes heat exchanger means.

17. A chemical reaction vessel according to claim 16 including a cylindrical inlet chamber contiguous with and attached to said first reaction chamber, said inlet chamber having a cylindrical inlet chamber wall attached to said first reaction chamber inlet end wall coincident with and encompassing said central first fluid inlet, and said inlet chamber cylindrical wall having a tangential fourth inlet opening communicating with said conduit means.

18. A chemical reaction vessel according to claim 11 including a cylindrical outer shell encompassing said first and second reaction chambers attached to said first reaction chamber inlet end wall and spaced apart from said first and second reaction chamber cylindrical walls to define an annular space.

19. A chemical reaction vessel according to claim 18 wherein a plurality of longitudinal vanes are attached to the outer surface of said first and second reaction chamber cylindrical walls and are projected into said annular space.

20. A chemical reaction vessel according to claim 18 including an inlet opening in said outer shell proximate to said second reaction chamber circular discharge wall.

21. A chemical reaction vessel according to claim 11 including a plenum chamber contiguous with and attached to said second reaction chamber, having a cylindrical plenum chamber wall encompassing said second reaction chamber discharge end wall, having a fluid outlet opening in the plenum chamber circular wall, and having a circular plenum chamber end wall.

22. A chemical reaction vessel according to claim 11 wherein said reaction chambers are in horizontal orientation.

23. A chemical reaction vessel according to claim 11 wherein said reaction chambers are in vertical orientation.

24. A chemical reaction vessel according to claim 23 wherein said second reaction chamber is below said first reaction chamber in a downflow process orientation.

25. A chemical reaction vessel according to claim 25 wherein said second reaction chamber is above said first reaction chamber in an upflow process orientation.

26. Method of burning a coal-water slurry which comprises the steps of:

(a) passing a feed stream containing a coal-water slurry into the inlet end of a cylindrical first combustion chamber having an inlet end wall, a first circular discharge end wall, and a first cylindrical side wall;

(b) passing a first combustion air stream tangentially into the inlet end of said cylindrical first combustion chamber under conditions sufficient to maintain a helical flow within said first combustion chamber and propel suspended coal particles centrifically toward the cylindrical side wall of the chamber;

(c) withdrawing a combustion product stream comprising steam, combustion gas components, unconsumed air components, uncombusted coal particles, and ash particles axially from the discharge end wall of said first combustion chamber;

(d) passing said combustion product stream into the inlet end of a cylindrical second combustion chamber having a second circular discharge end wall and a second cylindrical side wall;

(e) passing a second combustion air stream tangentially into the inlet end of said second combustion chamber under conditions sufficient to maintain a helical flow within said second combustion chamber and propel suspended coal and ash particles centrifically toward the second cylindrical side wall of the chamber;

(f) withdrawing ash particles tangentially from the discharge end of said second combustion chamber; and, (g) withdrawing flue gas axially from the discharge end of said second combustion chamber.

27. Method of claim 26 including the steps of:

(h) withdrawing a first mixture stream containing flue gas and ash particles tangentially from the discharge end of said second combustion chamber;

(i) passing coal-water slurry into said first mixture stream and thereby producing a second mixture stream; and, (j) passing said second mixture stream into said first cylindrical combustion chamber as at least a portion of the feed stream of step (a).

28. Method of claim 27 including the steps of withdrawing a third mixture stream containing flue gas and ash particles tangentially from the discharge end of said second combustion chamber, passing said third mixture stream through heat exchanger means, and returning cooled third mixture stream to said first cylindrical combustion chamber as a portion of the feed stream of step (a).

29. Method of claim 26 wherein said feed stream of step (a) is passed axially into said first combustion chamber.

30. Method of claim 29 wherein said feed stream of step (a) is passed into said first combustion chamber in a helical flow pattern.

31. Method of claim 26 wherein said feed stream of step (a) is passed into said first combustion chamber in a helical flow pattern.

32. Method of claim 26 wherein said combustion product stream is passed axially into the inlet end of said second combustion chamber.

33. Method of claim 32 wherein said combustion product stream is passed into said second combustion chamber in a helical flow pattern.

34. Method of claim 26 wherein said combustion product stream is passed into said second combustion chamber in a helical flow pattern.

35. Method of claim 26 wherein said first combustion air stream is at least partially preheated by passing over at least a portion of the outer surface of said first combustion chamber.

36. Method of claim 35 wherein said first combustion air stream is at least partially preheated by passing over at least a portion of the outer surface of the first and second combustion chambers.

37. Method of claim 26 wherein said second combustion air stream is at least partially preheated by passing over at least a portion of the outer surface of said second combustion chamber.

38. Method of claim 26 wherein said first and second combustion chambers are in a horizontal orientation, said first combustion air stream maintains a horizontal helical flow within the first combustion chamber, and said second combustion air stream maintains a horizontal helical flow within the second combustion chamber.

39. Method of claim 26 wherein said first and second combustion chambers are in a vertical orientation, said first combustion air stream maintains a downward helical flow within the first combustion chamber, and said second combustion air stream maintains a downward helical flow within the second combustion chamber.

40. Method of claim 26 wherein said first and second combustion chambers are in a vertical orientation, said first combustion air stream maintains an upward helical flow within the first combustion chamber, and said second combustion air stream maintains an upward helical flow within the second combustion chamber.

41. Method of burning a coal-water slurry which comprises the steps of:

(a) passing a feed stream containing a coal-water slurry into the inlet end of a cylindrical combustion chamber having a circular inlet end wall, a circular discharge end wall, and a cylindrical side wall;

(b) passing a combustion air stream tangentially into the inlet end of said cylindrical combustion chamber under conditions sufficient to maintain a helical flow within said combustion chamber and propel suspended coal particles centrifically toward the cylindrical side wall of the chamber;

(c) withdrawing ash particles tangentially from the discharge end of said combustion chamber;

(d) withdrawing flue gas axially from the discharge end of said combustion chamber;

(e) withdrawing a first mixture stream containing flue gas and ash particles tangentially from the discharge end of said second combustion chamber;

(f) passing coal-water slurry into said first mixture stream and thereby producing a second mixture stream; and, (g) passing said second mixture stream into said cylindrical combustion chamber as at least a portion of the feed stream of step (a).

42. Method of claim 41 including the steps of withdrawing a third mixture stream containing flue gas and ash particles tangentially from the discharge end of said combustion chamber, passing said third mixture stream through heat exchanger means, and returning cooled third mixture stream to said cylindrical combustion chamber as a portion of the feed stream of step (a).

43. Method of claim 41 wherein said feed stream of step (a) is passed axially into said combustion chamber.

44. Method of claim 43 wherein said feed stream of step (a) is passed into said combustion chamber in a helical flow pattern.

45. Method of claim 41 wherein said feed stream of step (a) is passed into said combustion chamber in a helical flow pattern.

46. Method of claim 41 wherein said combustion air stream is at least partially preheated by passing over at least a portion of the outer surface of said combustion chamber.

47. Method of claim 41 wherein said combustion chamber is in a horizontal orientation, and said combustion air stream maintains a horizontal helical flow within the combustion chamber.

48. Method of claim 41 wherein said combustion chamber is in a vertical orientation and said combustion air stream maintains a downward helical flow within the combustion chamber.

49. Method of claim 41 wherein said combustion chamber is in a vertical orientation, and said combustion air stream maintains an upward helical flow within the combustion chamber.

* * * * *